US011233343B2

(12) United States Patent
Ohta

(10) Patent No.: US 11,233,343 B2
(45) Date of Patent: Jan. 25, 2022

(54) ELECTRICAL CONNECTOR

(71) Applicant: 3M INNOVATIVE PROPERTIES COMPANY, Saint Paul, MN (US)

(72) Inventor: Toshio Ohta, Sahamihara (JP)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 378 days.

(21) Appl. No.: 16/086,107

(22) PCT Filed: Mar. 27, 2017

(86) PCT No.: PCT/US2017/024232
§ 371 (c)(1),
(2) Date: Sep. 18, 2018

(87) PCT Pub. No.: WO2017/172569
PCT Pub. Date: Oct. 5, 2017

(65) Prior Publication Data

US 2020/0303842 A1 Sep. 24, 2020

(30) Foreign Application Priority Data

Mar. 31, 2016 (JP) ..... JP2016-071323

(51) Int. Cl.
*H01R 4/2433* (2018.01)
*H01R 11/05* (2006.01)
(Continued)

(52) U.S. Cl.
CPC ..... *H01R 4/2433* (2013.01); *H01R 11/05* (2013.01); *H01R 12/675* (2013.01);
(Continued)

(58) Field of Classification Search
CPC .... H01R 4/2433; H01R 11/05; H01R 12/675; H01R 13/506; H01R 13/113; H01R 2107/00
See application file for complete search history.

(56) References Cited

U.S. PATENT DOCUMENTS 4,068,912 A 1/1978 Hudson et al.
4,350,404 A 9/1982 Clark
(Continued)

FOREIGN PATENT DOCUMENTS

DE 202014106058 U1 * 1/2015 ..... H01R 13/112
JP 11251007 9/1999
(Continued)

OTHER PUBLICATIONS

PCT International Search Report from PCT/US2017/024232 dated Jun. 21, 2017, 5 pages.

*Primary Examiner* — Briggitte R. Hammond
(74) *Attorney, Agent, or Firm* — Michael Stern

(57) ABSTRACT

[Problem] To provide a connector with improved reliability of electrical connection between a cable and a mating connector. [Resolution Means] A plurality of electrical contact terminals is provided on one side in a length direction and is provided with a first contact portion that is inserted into a support member and can contact a cable supported by this support member and a second contact portion that is provided on another side in the length direction and can contact terminal portions of a mating connector. A base member is provided with a bulkhead portion formed between a first receiving portion and a second receiving portion and a protruding wall portion protruding to the other side in the length direction from the bulkhead portion toward the second receiving portion. A plurality of channel portions that penetrates in the length direction and can receive the terminal portions of the mating connector is formed in the
(Continued)

protruding wall portion and the bulkhead portion, the plurality of channel portions is formed so as to be separated from each other in a width direction orthogonal to the length direction, and the second contact portion of the plurality of electrical contact terminals is housed in the plurality of channel portions.

13 Claims, 11 Drawing Sheets

(51) Int. Cl.
*H01R 12/67* (2011.01)
*H01R 13/506* (2006.01)
*H01R 13/11* (2006.01)
*H01R 107/00* (2006.01)

(52) U.S. Cl.
CPC ..... *H01R 13/113* (2013.01); *H01R 13/506* (2013.01); *H01R 2107/00* (2013.01)

(56) References Cited

U.S. PATENT DOCUMENTS 4,668,039 A 5/1987 Marzili
4,902,242 A * 2/1990 Davis ..... H01R 13/741 439/404
5,129,840 A * 7/1992 Kuzuno ..... H01R 12/675 439/397
5,643,005 A * 7/1997 Weidler ..... H01R 12/675 439/405
5,833,486 A 11/1998 Shinozaki
5,890,924 A * 4/1999 Endo ..... H01R 4/2433 439/404
6,953,363 B2 * 10/2005 Kameyama ..... H01R 4/2429 439/404
7,494,364 B2 * 2/2009 Sakamoto ..... H01R 4/2429 439/395
7,503,797 B2 * 3/2009 Lappoehn ..... H01R 4/2433 439/404
8,105,105 B2 * 1/2012 Taniguchi ..... H01R 4/2425 439/395
8,403,708 B2 * 3/2013 Ohta ..... G01R 1/0416 439/620.04
9,209,545 B2 * 12/2015 Hemmi ..... H01R 4/2462
10,020,598 B2 * 7/2018 Lappoehn ..... H01R 13/506
10,074,914 B2 * 9/2018 Lappoehn ..... H01R 13/112
10,476,179 B2 * 11/2019 Hayashi ..... H01R 4/2433
2004/0185703 A1 9/2004 Lee
2007/0128907 A1 6/2007 Sakamoto
2010/0167579 A1 7/2010 Hayauchi
2014/0213125 A1 7/2014 Hemmi et al.
2017/0373405 A1 12/2017 Lappoehn

FOREIGN PATENT DOCUMENTS

JP 2001-035554 2/2001
JP 2001035554 A * 2/2001
JP 2003-173827 6/2003
JP 2003-173835 6/2003

* cited by examiner

ELECTRICAL CONNECTOR

FIELD

One aspect of the present invention relates to a connector.

BACKGROUND

Various types of connectors that electrically connect a cable and a mating connector are conventionally known. There is a case where as an electrical contact terminal used in such a connector, one described in Patent Literature 1 below is used. Because a plurality of such electrical contact terminals is provided in the connector, when connecting to a mating connector on an opposite side, terminal portions of the mating connector are connected to corresponding electrical contact terminals.

CITATION LIST

Patent Literature

[Patent Literature 1] Japanese Unexamined Patent Application 2003-173835

SUMMARY

Technical Problem

Here, with a connector using electrical contact terminals such as those illustrated in Patent Literature 1 above, there is a case where reliability of electrical connection between the cable and the mating connector decreases by, for example, the terminal portions of the mating connector contacting other electrical contact terminals disposed adjacent to the corresponding electrical contact terminals. Therefore, there is demand for a connector with improved reliability in electrical connection between the cable and the mating connector.

Solution to Problem

A connector according to one aspect of the present invention is a connector that electrically connects a cable and a mating connector, provided with: a support member that can support the cable; a base member provided with a first receiving portion that is provided on one side in a length direction and can receive the support member and a second receiving portion that is provided on another side in the length direction and can receive the mating connector; a cover member that is installable to the base member from an upper side and covers the support member received by the first receiving portion; and a plurality of electrical contact terminals that can contact the cable and terminal portions of the mating connector; wherein the plurality of electrical contact terminals is provided with a first contact portion that is provided on one side in the length direction, is inserted into the support member, and can contact the cable supported by this support member and a second contact portion that is provided on another side in the length direction and can contact the terminal portions of the mating connector; the base member is provided with a bulkhead portion formed between the first receiving portion and the second receiving portion and a protruding wall portion protruding to another side in the length direction from the bulkhead portion in toward the second receiving portion; a plurality of channel portions that penetrates in the length direction and can receive the terminal portions of the mating connector is formed in the protruding wall portion and the bulkhead portion; the plurality of channel portions is formed so as to be separated from each other in a width direction orthogonal to the length direction; and the second contact portion of the plurality of electrical contact terminals is housed in the plurality of channel portions.

In such an aspect, the cable, supported by the support member, which is received by the first receiving portion of the base member, and the cover member, contacts the first contact portion of the electrical contact terminals. The terminal portions of the mating connector, which is received by the second receiving portion of the base member, contact the second contact portion of the electrical contact terminals. By this, the cable and the mating connector are electrically connected in a state of being supported by the connector. Here, the protruding wall portion is disposed inside the second receiving portion that can receive the mating connector. Moreover, the plurality of channel portions that penetrates in the length direction and can receive the terminal portions of the mating connector is formed in the protruding wall portion and the bulkhead portion. The second contact portion of the plurality of electrical contact terminals is housed in the channel portions. The plurality of channel portions configured in this manner is formed so as to be separated from each other in the width direction orthogonal to the length direction. That is, the channel portions are in a state of being spatially separated from each other by walls of the protruding wall portion. Accordingly, the terminal portions of the mating connector received in the channel portions are separated from each other by the walls of the protruding wall portion. By such a configuration, the terminal portions are prevented from electrically contacting or approaching each other and reliability of electrical connection between the cable and the mating connector can be improved.

Advantageous Effects of Invention

According to one aspect of the present invention, reliability of electrical connection between a cable and a mating connector can be improved.

DESCRIPTION OF EMBODIMENTS

Figure 1:
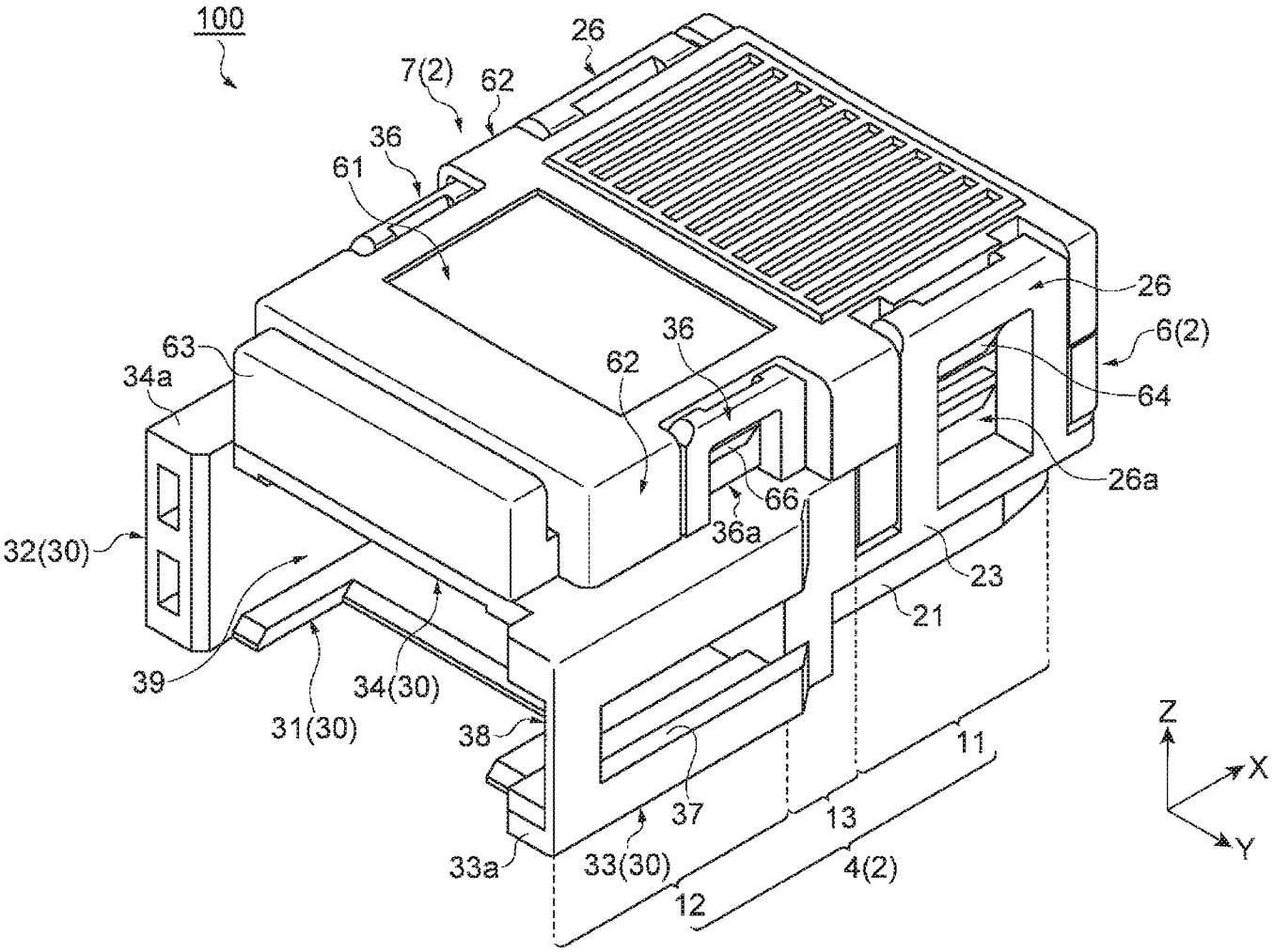
FIG. 1 A perspective view illustrating a connector according to an embodiment.
Figure 2:
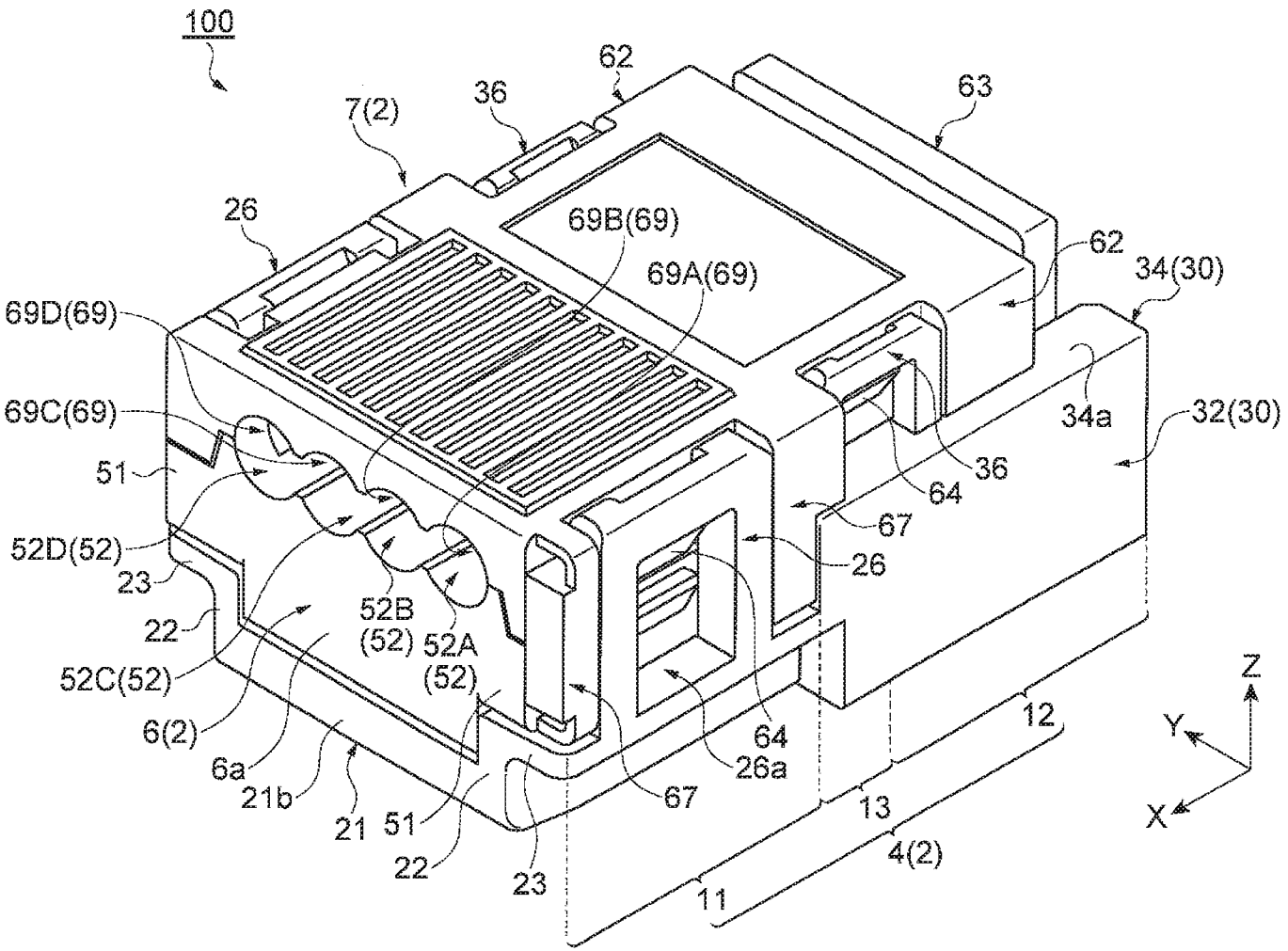
FIG. 2 A perspective view illustrating the connector according to the embodiment.

Embodiments of the present invention are described in detail below with reference to the included drawings. Note that in the description below, identical or equivalent elements are labeled with identical reference numerals and redundant description is omitted. Moreover, the terms "x-axis direction," "y-axis direction," and "z-axis direction" are based on illustrated directions and are for convenience.

As illustrated in FIGS. 1 to 6 and 10, a connector 100 is for electrically connecting a cable 101 and a mating connector 102. In the present embodiment, a case is described where four cables 101 are lined up. Each cable 101 is configured by covering a conductor portion configured by a conductive material by a covering portion configured by an insulator. The connector 100 is provided with a housing 2 that extends from one side to another side in a length direction and a plurality of electrical contact terminals 3 that contacts and electrically connects the cables 101 and the mating connector 102. Moreover, the housing 2 is provided with a base member 4, a support member 6, and a cover member 7. Note that in the present embodiment, a length direction of the housing 2 is defined as an x-axis direction, one side thereof being an x-axis-direction positive side and another side thereof being an x-axis-direction negative side. Moreover, an up-and-down direction of the housing 2 is defined as a z-axis direction, an upper side thereof being a z-axis-direction positive side and a lower side thereof being a z-axis-direction negative side. Moreover, a width direction perpendicular to an x axis and a z axis is defined as a y-axis direction, one side thereof being a y-axis-direction positive side and another side thereof being a y-axis-direction negative side.

[Base Member]

The base member 4 is a member that supports the support member 6, the electrical contact terminals 3, and the cover member 7 on the z-axis-direction negative side—that is, a bottom side of the connector 100. The base member 4 is provided with a first receiving portion 11 that is provided on the x-axis-direction positive side (one side in the length direction) and can receive the support member 6, a second receiving portion 12 that is provided on the x-axis-direction negative side (other side in the length direction) and can receive the mating connector 102, and a bulkhead portion 13 formed between the first receiving portion 11 and the second receiving portion 12.

The bulkhead portion 13 is a rectangular wall portion that is spread over a yz-axis plane and extends in the y-axis direction. Moreover, the bulkhead portion 13 has a front wall surface 13*a* on the x-axis-direction positive side and a rear wall surface 13*b* on the x-axis-direction negative side (see FIG. 5). The bulkhead portion 13 is disposed in a vicinity of a central position of the connector 100 in the x-axis direction. Wall portions configuring the first receiving portion 11 are formed on a front-wall-surface 13*a* side of the bulkhead portion 13. Wall portions configuring the second receiving portion 12 and a protruding wall portion 16 (see FIG. 5) in which the electrical contact terminals 3 are housed are formed on a rear-wall-surface 13*b* side of the bulkhead portion 13.

Figure 4:
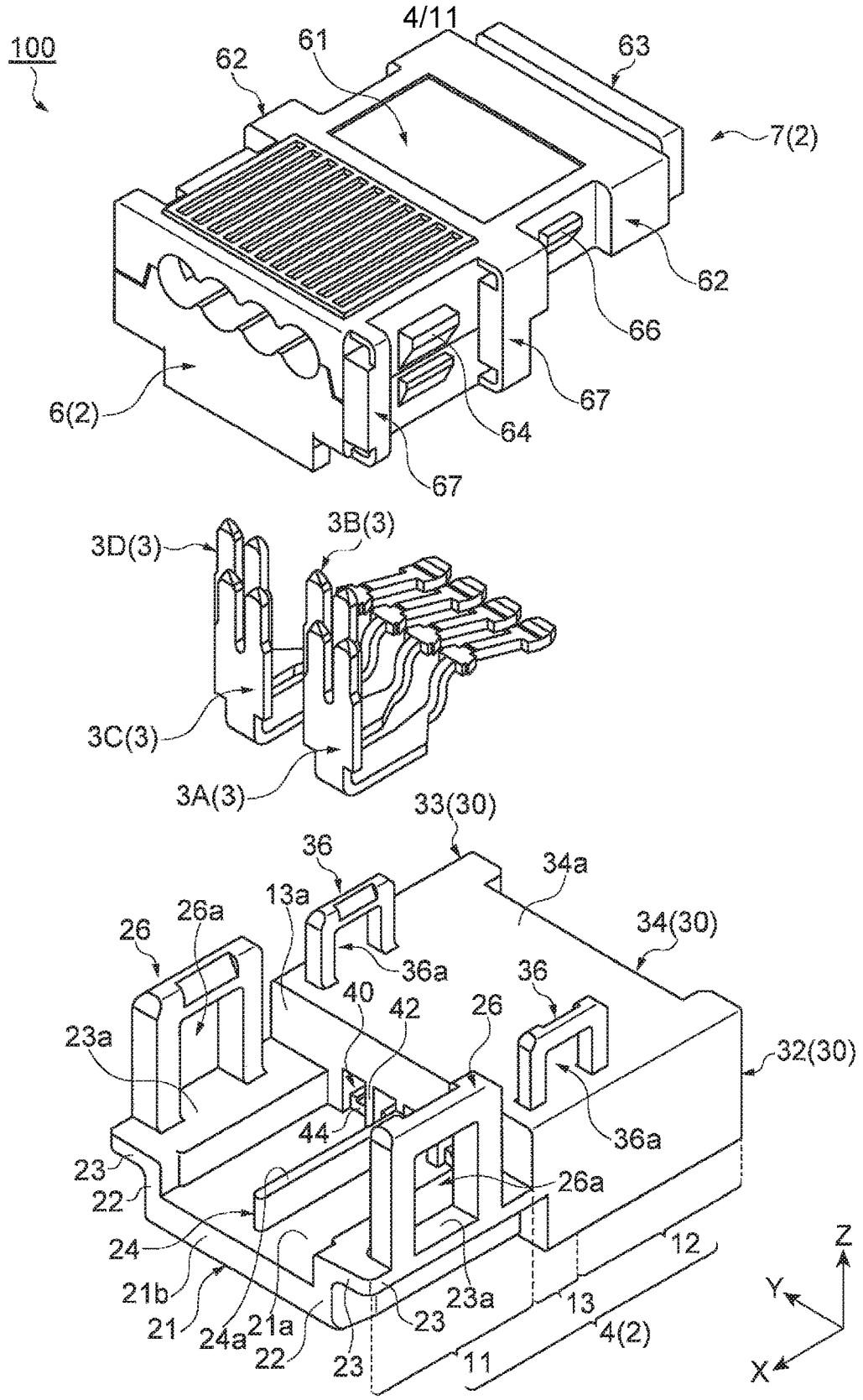
FIG. 4 An exploded perspective view of the connector according to the embodiment.

The first receiving portion 11 has a configuration where the support member 6 can be received from the z-axis-direction positive side (that is, from above). The first receiving portion 11 has a configuration of being opened to the z-axis-direction positive side. Moreover, the first receiving portion 11 has a configuration that can fix the received support member 6 by interposition between the first receiving portion 11 and the cover member 7. Specifically, as illustrated in FIG. 4, the first receiving portion 11 is provided with a bottom wall portion 21; a pair of sidewall portions 22, 22; a pair of seat portions 23, 23; an inner wall portion 24; and a pair of holding portions 26, 26. The bottom wall portion 21; the pair of sidewall portions 22, 22; the pair of seat portions 23, 23; and the inner wall portion 24 extend from the front wall surface 13*a* of the bulkhead portion 13 toward the x-axis-direction positive side. Lengths of each wall portion are not limited in particular; however, in the present embodiment, the bottom wall portion 21; the pair of sidewall portions 22, 22; and the pair of seat portions 23, 23 protrude by identical dimensions from the front wall surface 13*a* to the x-axis-direction positive side. Moreover, the inner wall portion 24 protrudes from the front wall surface 13*a* by a dimension shorter than the bottom wall portion 21; the pair of sidewall portions 22, 22; and the pair of seat portions 23, 23.

The bottom wall portion 21 is spread in the y-axis direction along a lower edge portion of the bulkhead portion 13. Note that widths and heights of the wall portions are not particularly limited; however, both end portions in the y-axis direction of the bottom wall portion 21 are disposed on an inner side of both end portions in the y-axis direction of the bulkhead portion 13. Moreover, the pair of sidewall portions 22, 22 extends along both edge portions in the y-axis direction of the bottom wall portion 21 and stands up toward the z-axis-direction positive side. Moreover, the pair of seat portions 23, 23 is spread from upper end portions of the sidewall portions 22, 22 toward an outer side in the y-axis direction. An end portion on the outer side in the y-axis direction of the seat portions 23, 23 extends to a position of both end portions on the outer side in the y-axis direction of the bulkhead portion 13.

Moreover, seat surfaces 23*a*, 23*a* configured by an upper surface of the seat portions 23, 23 are formed in a position on a z-axis-direction negative side of (that is, in a position lower than) an upper edge portion of the bulkhead portion 13. The seat surfaces 23*a*, 23*a* function as a surface that contacts and supports a lower surface of both edge portions in the y-axis direction of the support member 6 when the support member 6 is received by the receiving portion 11. Note that an upper surface 21*a* of the bottom wall portion 21 is formed in a position on a z-axis-direction negative side of the seat surfaces 23*a*, 23*a*. The inner wall portion 24 extends rectilinearly from a y-axis-direction central position in the front wall surface 13*a* of the bulkhead portion 13 to the x-axis-direction positive side. Moreover, the inner wall portion 24 protrudes from the upper surface 21*a* of the bottom wall portion 21 to the z-axis-direction positive side. An upper end portion 24*a* of the inner wall portion 24 may be disposed in the same position in the z-axis direction as the seat surface 23*a*. However, height positions and the like of the wall portions are not particularly limited and may be changed as appropriate according to configurations of the support member 6 and the electrical contact terminals 3.

The pair of holding portions 26, 26 is formed on end portions on the y-axis-direction outer side of the seat portions 23, 23. The holding portions 26, 26 are configured by rectangular, frame-shaped members extending from the seat surfaces 23*a*, 23*a* toward the z-axis-direction positive side. Rectangular through holes 26*a*, 26*a* that penetrate in the y-axis direction are formed in the holding portions 26, 26.

The holding portions 26, 26 lock an engaging portion of the cover member 7, which is described below.

Figure 3:
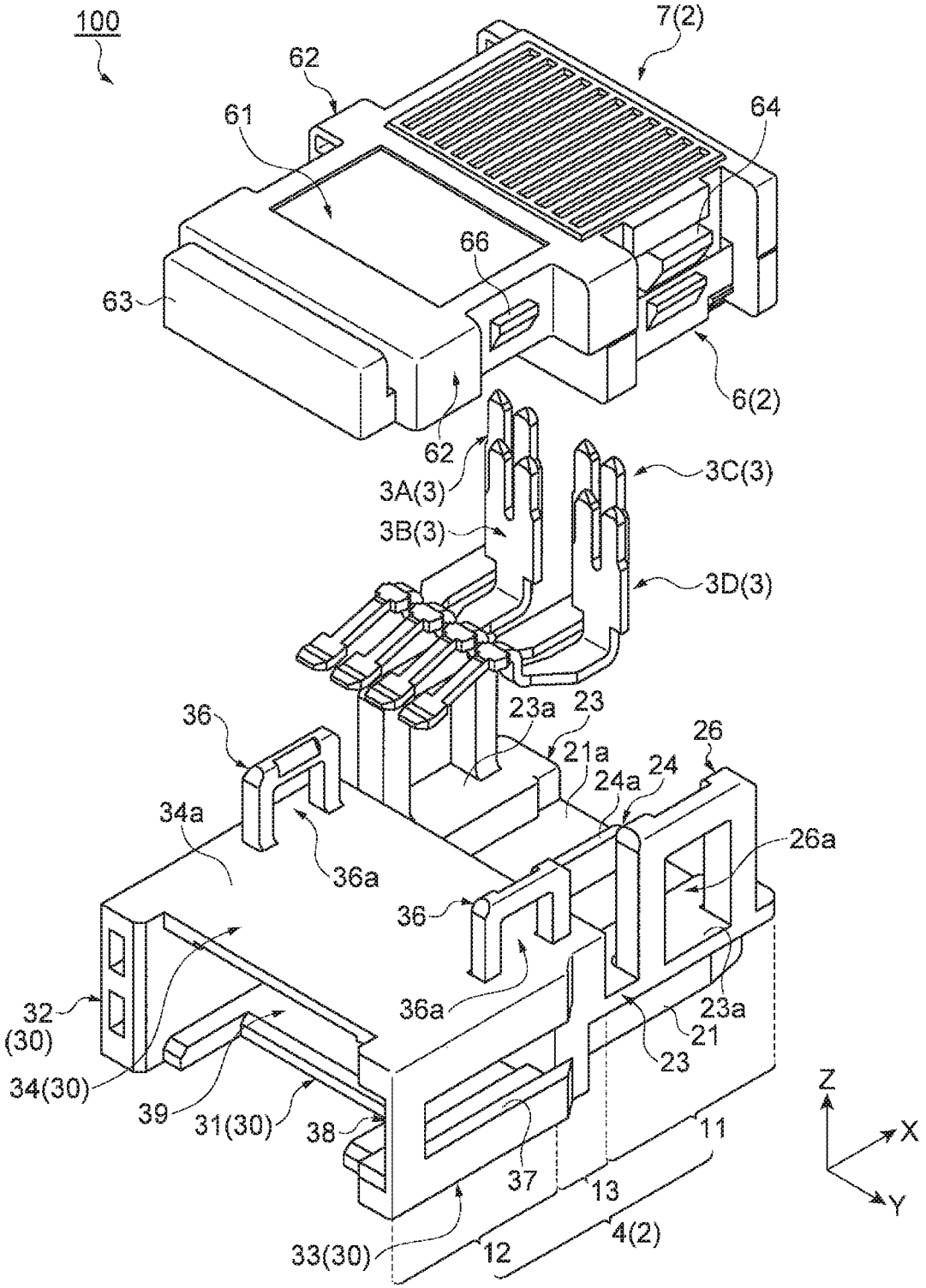
FIG. 3 An exploded perspective view of the connector according to the embodiment.
Figure 5:
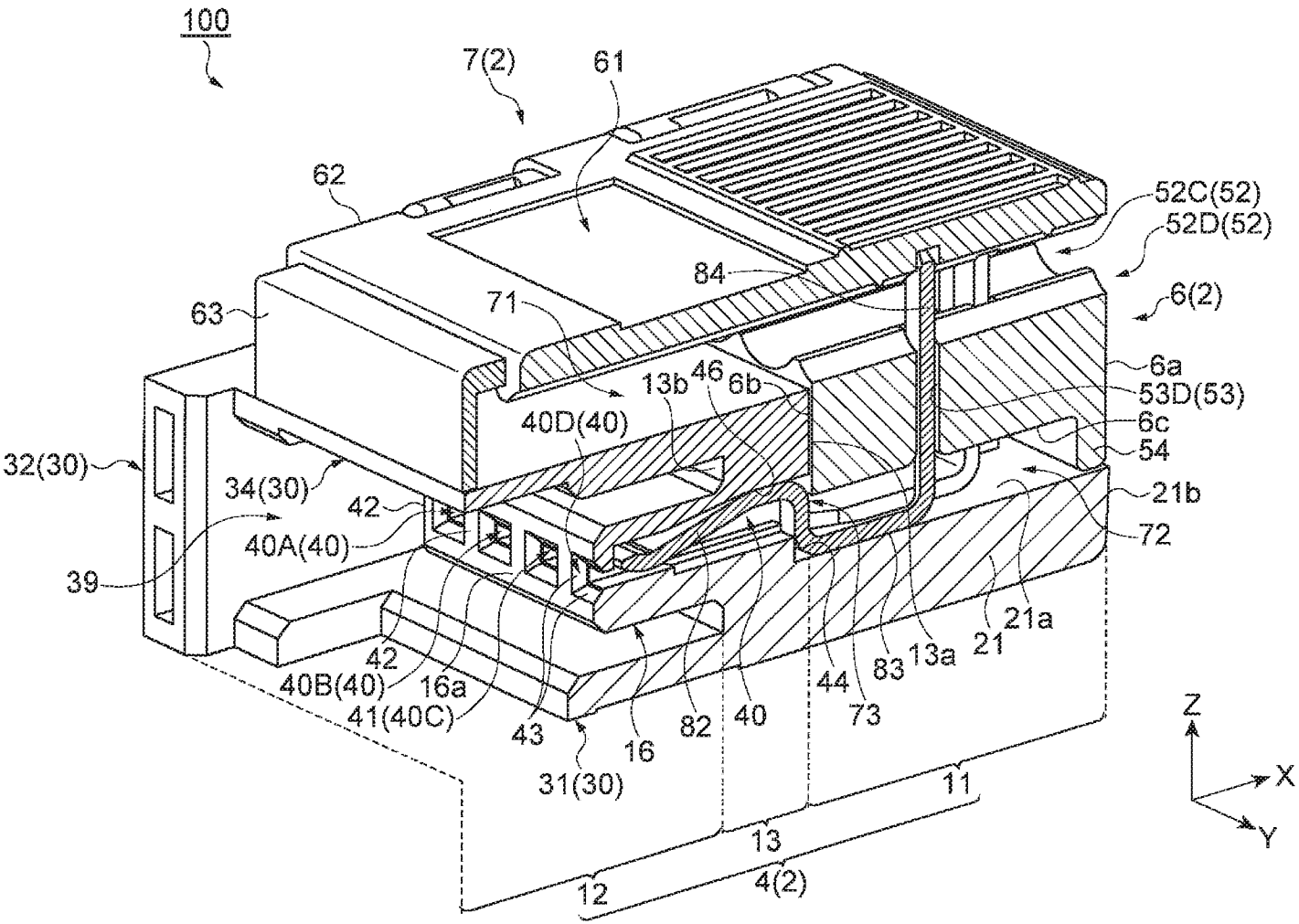
FIG. 5 A cross-sectional perspective view of the connector according to the embodiment.

The second receiving portion 12 has a configuration that can receive the mating connector 102 from the x-axis-direction negative side. The second receiving portion 12 has a configuration of being opened to the x-axis-direction negative side. Moreover, the second receiving portion 12 has a configuration that can mate with the received mating connector 102. Specifically, as illustrated in FIGS. 3 and 5, the second receiving portion 12 is provided with a peripheral wall portion 30 that, when viewing the positive side in the x-axis direction from the negative side in the x-axis direction, is disposed so as to surround the protruding wall portion 16, which is described below, and extends in the x-axis direction. The peripheral wall portion 30 is provided with a bottom wall portion 31; a pair of sidewall portions 32, 33; and an upper wall portion 34. The bottom sidewall portion 31; the pair of sidewall portions 32, 33; and the upper wall portion 34 extend from the rear wall surface 13*b* of the bulkhead portion 13 toward the x-axis-direction negative side. The pair of sidewall portions 32 extends so as to protrude to an x-axis-direction negative side of the bottom wall portion 31 and the upper wall portion 34.

The bottom wall portion 31 is spread in the y-axis direction along the lower edge portion of the bulkhead portion 13. The upper wall portion 34 spans in the y-axis direction along the upper edge portion of the bulkhead portion 13. Note that both end portions in the y-axis direction of the bottom wall portion 31 and the upper wall portion 34 are disposed in the same position as both end portions in the y-axis direction of the bulkhead portion 13. Moreover, the pair of sidewall portions 32, 33 extends along both edge portions in the y-axis direction of the bottom wall portion 31 and the upper wall portion 34 and is spread in the z-axis direction. By such a configuration, a housing space 39 for housing the mating connector 102 is formed inside a space surrounded by the bottom wall portion 31; the sidewall portions 32, 33; and the upper wall portion 34.

Moreover, a concave portion 38 that is recessed rectangularly from an inner surface on a housing-space 39 side to the y-axis-direction positive side when viewing the positive side in the x-axis direction from the negative side in the x-axis direction is formed in the sidewall portion 33, which is on the y-axis-direction positive side. This concave portion 38 extends from a tip portion 33*a* on the x-axis-direction negative side of the sidewall portion 33 to the rear wall surface 13*b* of the bulkhead portion 13. Moreover, a slit portion 37 that penetrates in the y-axis direction and extends in the x-axis direction is formed in the concave portion 38. When the mating connector 102 is housed in the housing space 39, this slit portion 37 mates with a claw portion 103 formed on a side surface of the mating connector 102.

A pair of holding portions 36, 36 is formed on both end portions in the y-axis direction on an upper surface 34*a* of the upper wall portion 34. The holding portions 36, 36 are formed in a position more negative in the x-axis direction on both end portions in the y-axis direction of the upper surface 34*a*. The holding portions 36, 36 are configured by a rectangular, frame-like member extending from the upper surface 34*a* toward the z-axis-direction positive side. Rectangular through holes 36*a*, 36*a* that penetrate in the y-axis direction are formed in the holding portions 36, 36. The holding portions 36, 36 lock the engaging portion of the cover member 7, which is described below.

As illustrated in FIG. 5, the protruding wall portion 16 protrudes to the x-axis-direction negative side in the x-axis direction from the rear wall surface 13*b* of the bulkhead portion 13 in toward the second receiving portion 12. The protruding wall portion 16 has a rectangular shape extending in the y-axis direction when viewed from the x-axis direction. Moreover, four side surfaces of the protruding wall portion 16 are respectively disposed in positions separated inward from the bottom wall portion 31; the sidewall portions 32, 33; and the upper wall portion 34. That is, a gap is formed between the four side surfaces of the protruding wall portion 16 and the bottom wall portion 31; the sidewall portions 32, 33; and the upper wall portion 34. Moreover, because a protruding amount of the protruding wall portion 16 is less than that of the peripheral wall portion 30, a tip 16*a* of the protruding wall portion 16 is disposed on an x-axis-direction positive side of a tip of the peripheral wall portion 30.

A plurality of channel portions 40 that penetrates in the x-axis direction and can receive a terminal portion 110 of the mating connector 102 is formed in the protruding wall portion 16 and the bulkhead portion 13. The channel portions 40 are configured by through holes extending from the tip 16*a* of the protruding wall portion 16 to the front wall surface 13*a* of the bulkhead portion 13. A plurality (four in the present embodiment) of channel portions 40 is formed in the y-axis direction in the protruding wall portion 16. Note that in the description below, these may be referred to sequentially from the y-axis-direction negative side to the y-axis-direction positive side as "channel portion 40A," "channel portion 40B," "channel portion 40C," and "channel portion 40D." The plurality of channel portions 40 is formed so as to be separated from each other in the y-axis direction. That is, one channel portion 40 and another channel portion 40 adjacent thereto is separated by a horizontal wall portion 42. Moreover, end portions on the y-axis-direction outer sides of the channel portions 40 disposed on both ends in the y-axis direction are also sealed by the horizontal wall portion 42. Note that the channel portions 40 are disposed in a position higher than the upper surface 21*a* of the bottom wall portion 21 of the first receiving portion 11 (see FIG. 4).

An opening portion 41 of the channel portions 40 is formed in the tip 16*a* of the protruding wall portion 16. The opening portion 41 has a rectangular shape. A taper 43 is formed in a peripheral portion of the opening portion 41. The peripheral portion has a horizontally-opposing pair of side portions in the z-axis direction and a horizontally-opposing pair of side portions in the y-axis direction. The taper 43 is formed over all four side portions. However, it is sufficient for the taper 43 to be formed in any of the four side portions; alternatively, the taper 43 does not have to be formed.

A rectangular opening portion of the channel portions 40 is formed in the front wall surface 13*a* of the bulkhead portion 13. Of a peripheral portion of this opening portion, a side portion 44 on the z-axis-direction negative side (see FIGS. 4 and 5) may be disposed in a position deeper than the front wall surface 13*a*—that is, on the x-axis-direction negative side. Moreover, in an inner surface of the channel portions 40, an inner surface in the z-axis-direction positive side may have an inclined portion 46 inclining diagonally downward from the front wall surface 13*a* to the tip 16*a* of the protruding wall portion 16 (see FIG. 5).

[Support Member]

Figure 6:
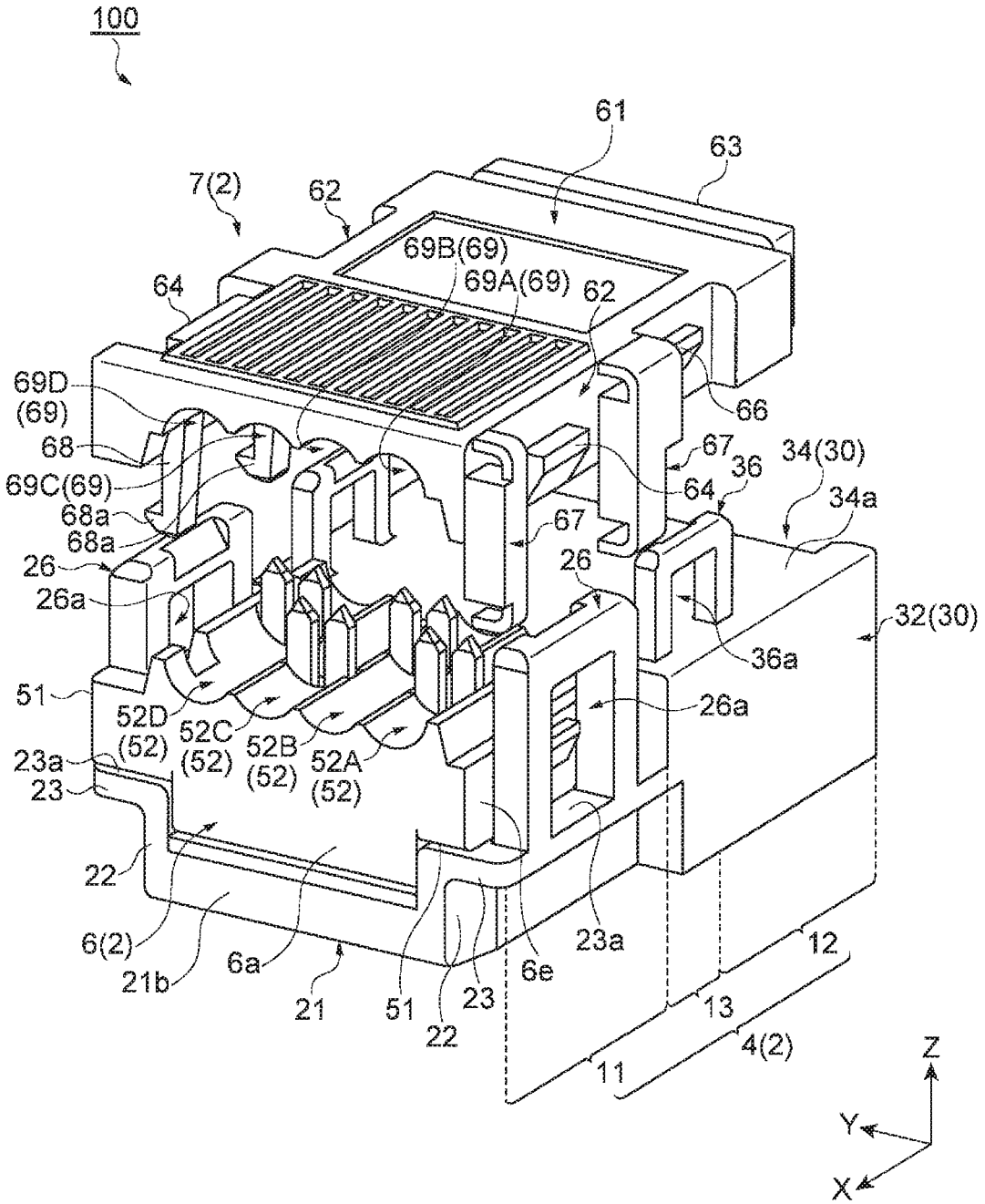
FIG. 6 An exploded perspective view of the connector according to the embodiment.
Figure 7:
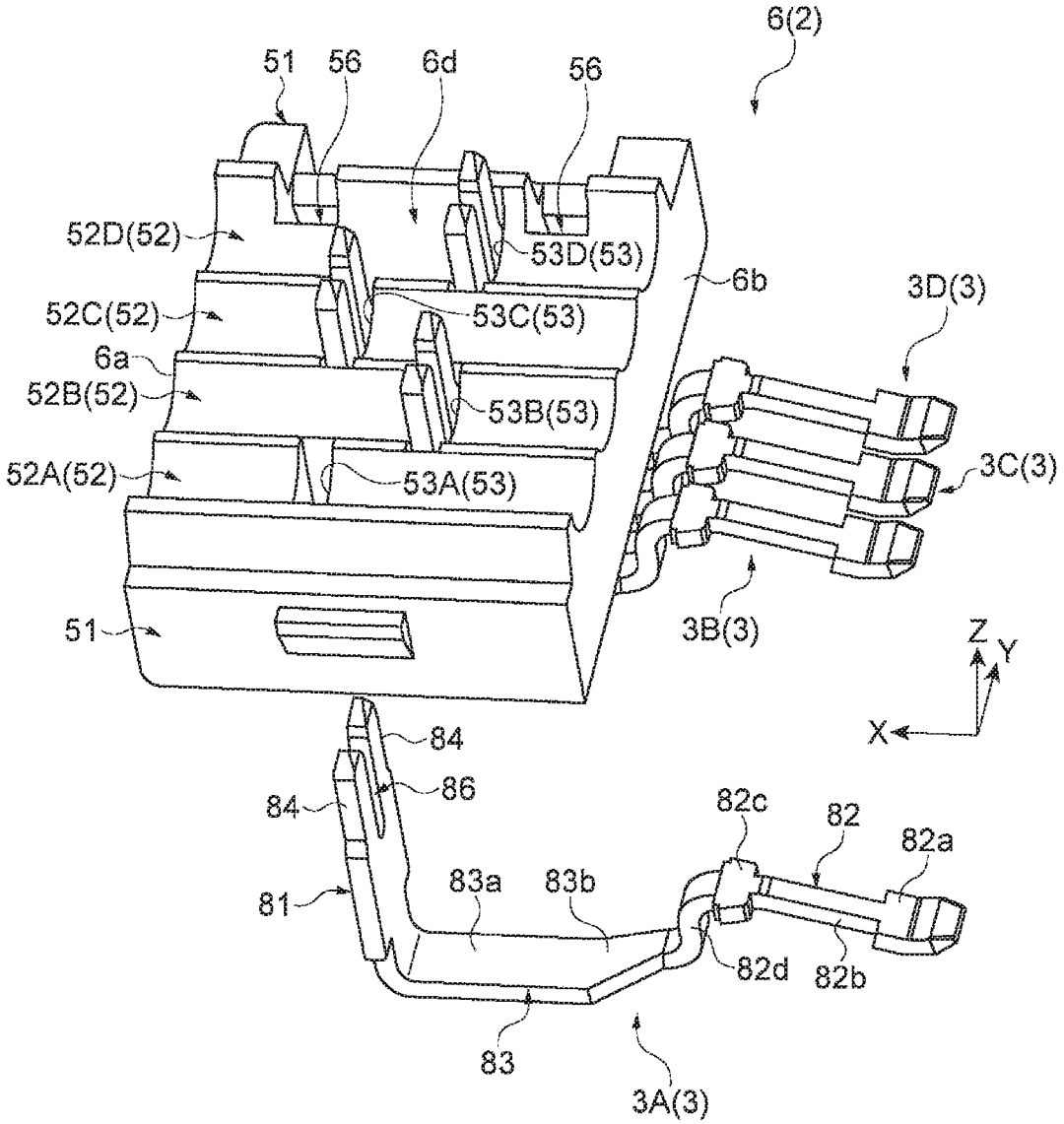
FIG. 7 A perspective view of a support member and electrical contact terminals of the connector according to the embodiment.

The configuration of the support member 6 is described principally with reference to FIGS. 5, 6, and 7. The support member 6 is a member that can support the cables 101. The support member 6 is a member that is received by the first receiving portion 11 of the base member 4 and is separable from this first receiving portion 11. A shape of the support member 6 is not particularly limited as long as it is receivable by the first receiving portion 11; in the present embodiment, the support member 6 has an overall rectangular shape.

A length, a width, and a height of the support member 6 are not particularly limited; in the present embodiment, an end surface 6*a* on the x-axis-direction positive side of the support member 6 is disposed so as to substantially match an end surface 21*b* on the x-axis-direction positive side of the bottom wall portion 21 in a state where the support member 6 is received by the first receiving portion 11. Moreover, an end surface 6*b* on the x-axis-direction negative side of the support member 6 is disposed so as to substantially match the end surface 21*b* on the x-axis-direction positive side of the bottom wall portion 21. Both end portions 51, 51 in the y-axis direction of the support member 6 are disposed on the seat surfaces 23*a*, 23*a* of the seat portions 23, 23 of the first receiving portion 11. That is, a lower surface 6*c* of the support member 6 is disposed in a position equivalent to a height of the seat surfaces 23*a*, 23*a*. Accordingly, the lower surface 6*c* of the support member 6 is disposed in a position separated from the upper surface 21*a* of the bottom wall portion 21 to the z-axis-direction positive side. By such a configuration, the support member 6 in the state of being received by the first receiving portion 11 is disposed in a position separated upward from the bottom wall portion 21. A bottom-side space portion 72 is formed between the support member 6 in the state of being received by the first receiving portion 11 and the bottom wall portion 21. The support member 6 is provided with a protruding portion 54 extending from an end portion on the x-axis-direction positive side toward the z-axis-direction negative side. The protruding portion 54 has a shape of entering downward from above to a concave portion configured by the sidewall portions 22, 22 and the bottom wall portion 21 of the first receiving portion 11.

A plurality (four in the present embodiment, to match the number of cables 101) of groove portions 52 extending along the x-axis direction is formed in the y-axis direction (width direction) in an upper surface 6*d* of the support member 6. The groove portions 52 form an arc when viewed from the x-axis direction. The upper surface 6*d* of the support member 6 may be disposed in substantially the same position in the z-axis direction as the upper surface 34*a* of the second receiving portion 12. Note that in the description below, these may be referred to sequentially from the y-axis-direction negative side to the y-axis-direction positive side as "groove portion 52A," "groove portion 52B," "groove portion 52C," and "groove portion 52D."

The support member 6 has a through hole 53 extending in the z-axis direction (up-and-down direction) into which a first contact portion 81 of the electrical contact terminal 3 is inserted. A plurality (four in the present embodiment) of through holes 53 is formed corresponding to each of the plurality of groove portions 52. The through holes 53 are slit-shaped holes spread in the y-axis direction. Note that in the description below, these may be referred to sequentially from the y-axis-direction negative side to the y-axis-direction positive side as "through hole 53A," "through hole 53B," "through hole 53C," and "through hole 53D." That is, the through hole 53A is formed in a position corresponding to the groove portion 52A, the through hole 53B is formed in a position corresponding to the groove portion 52B, the through hole 53C is formed in a position corresponding to the groove portion 52C, and the through hole 53D is formed in a position corresponding to the groove portion 52D. The through holes 53A, 53B, 53C, 53D are disposed in a staggered pattern in a substantially central position in the x-axis direction of the support member 6. In the present embodiment, the through holes 53A and 53C are disposed in positions on the positive side in the x-axis direction and the through holes 53B and 53D are disposed in positions on the negative side in the x-axis direction. However, shapes and positions of the through holes 53 are not particularly limited. Note that a pair of through holes 56, 56 for a hook member of the cover member 7 described below to be inserted into is formed in the end portion 51 on the y-axis-direction positive side of the support member 6.

[Cover Member]

The cover member 7 is a member that is installable to the base member 4 from the z-axis-direction positive side. The cover member 7 is a member that covers the support member 6 received by the first receiving portion 11. Moreover, the cover member 7 also functions as a member that interposes the cables 101 between the support member 6 and the base member 4. The cover member 7 extends in the x-axis direction so as to cover positions corresponding to the first receiving portion 11, the bulkhead portion 13, and the second receiving portion 12. The cover member 7 is provided with an upper wall portion 61 of a flat-plate shape spread in an xy direction; sidewall portions 62, 62 extending from both ends in the y-axis direction of the upper wall portion 61 toward the z-axis-direction negative side; and a lid portion 63 formed on an end portion on the negative side in the x-axis direction of the upper wall portion 61.

The upper wall portion 61 is formed so as to cover the upper surface 34*a* of the second receiving portion 12 and the upper surface 6*d* of the support member 6 in the state where the support member 6 is received by the first receiving portion 11 of the base member 4. The sidewall portions 62, 62 extend in the x-axis direction along both end portions in the y-axis direction of the upper wall portion 61. Note that the sidewall portions 62, 62 are recessed in a concave shape to a y-axis-direction inner side in positions corresponding to the holding portions 26, 26 and the holding portions 36, 36 of the base member 4. However, a shape of the sidewall portions 62, 62 is not particularly limited. Moreover, in the sidewall portions 62, 62, locking portions 64, 64 that protrude toward the y-axis-direction outer side are formed in positions corresponding to the holding portions 26, 26 of the first receiving portion 11. In the sidewall portions 62, 62, locking portions 66, 66 that protrude toward the y-axis-direction outer side are formed in positions corresponding to the holding portions 36, 36 of the second receiving portion 12. In a state where the cover member 7 is installed to the base member 4 (for example, the state illustrated in FIGS. 1 and 2), the locking portions 64, 64 are disposed in the through holes 26*a*, 26*a* of the holding portions 26, 26 and locked to an edge portion on an upper side of these through holes 26*a*, 26*a*. The locking portions 66, 66 are disposed in the through holes 36*a*, 36*a* of the holding portions 36, 36 and locked to an edge portion on an upper side of these through holes 36*a*, 36*a*.

Moreover, as illustrated in FIG. 6, one sidewall portion 62 (here, the one on the y-axis-direction negative side) of the cover member 7 is linked to a side surface 6*e* of the support member 6 via linking portions 67, 67. Specifically, the linking portions 67, 67 are provided on both sides in the x-axis direction of the locking portion 64 in the sidewall portion 62. The linking portion 67 is a member of a strip shape (a portion thereof does not have to be of a strip shape) extending in the z-axis direction and is connected to the side surface 6*e* of the support member 6. Hook portions 68, 68 extending to the z-axis-direction negative side are formed on the other sidewall portion 62 (here, the one on the y-axis-direction positive side) of the cover member 7. The hook portions 68, 68 are provided on both sides in the x-axis direction of the locking portion 64 in the sidewall portion 62. In a state where the support member 6 and the cover member 7 are closed, the hook portions 68, 68 are inserted into the through holes 56, 56 of the support member 6. Moreover, locking portions 68*a*, 68*a* at a tip of the hook portions 68, 68 inserted into the through holes 56 engage with an edge portion on a lower-surface side of the through holes 56, 56. Note that in FIG. 6, for convenience in description, the support member 6 and the cover member 7 are illustrated separated in the z-axis direction in a state where the link between the linking portions 67, 67 and the support member 6 is released. The support member 6 is configured to be able to open and close by rotating relative to the cover member 7 with the linking portions 67, 67 as a fulcrum during actual operation. In this manner, as components, the cover member 7 and the support member 6 may be separate components or a member molded simultaneously together with the linking portions in one molding during manufacturing. However, the linking portions 67, 67 do not have to be provided, and the support member 6 and the cover member 7 may be separable.

A plurality (four in the present embodiment, to match the number of cables 101) of groove portions 69 extending along the x-axis direction is formed in a lower surface of the upper wall portion 61 of the cover member 7. The groove portions 69 form an arc when viewed from the x-axis direction. Note that in the description below, these may be referred to sequentially from the y-axis-direction negative side to the y-axis-direction positive side as "groove portion 69A," "groove portion 69B," "groove portion 69C," and "groove portion 69D." The groove portion 69A is formed in a position corresponding to the groove portion 52A, the groove portion 69B is formed in a position corresponding to the groove portion 52B, the groove portion 69C is formed in a position corresponding to the groove portion 52C, and the groove portion 69D is formed in a position corresponding to the groove portion 52D. In the state where the cover member 7 is installed to the base member 4, the lower surface of the upper wall portion 61 and the upper surfaces of the support member 6 and the cover member 7 are separated from each other in the z-axis direction. An upper-side space portion 71 that can house the cables 101 is formed between the cover member 7 and the second receiving portion 12 and between the cover member 7 and the support member 6.

Figure 11A:
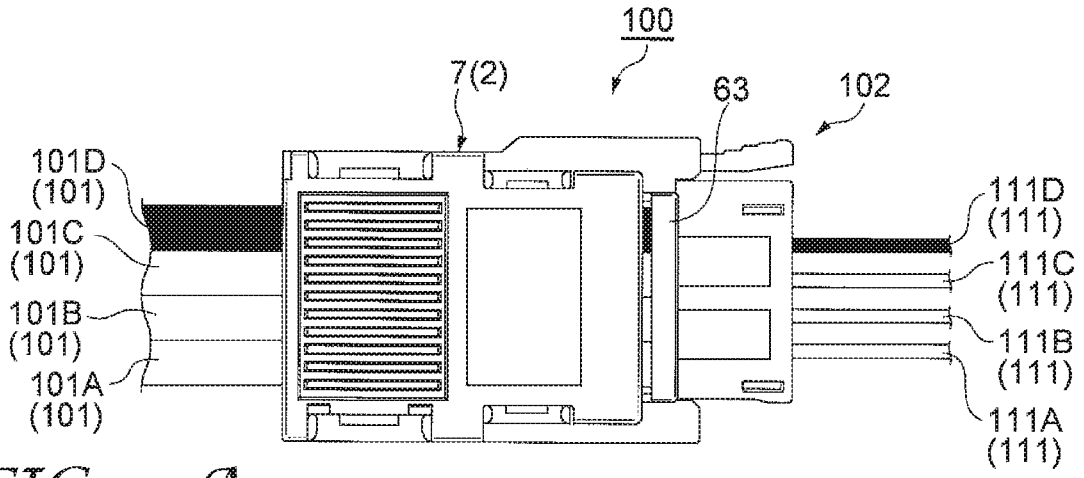
FIG. 11 A conceptual diagram illustrating the connector with the cable and the mating connector connected.
Figure 11B:
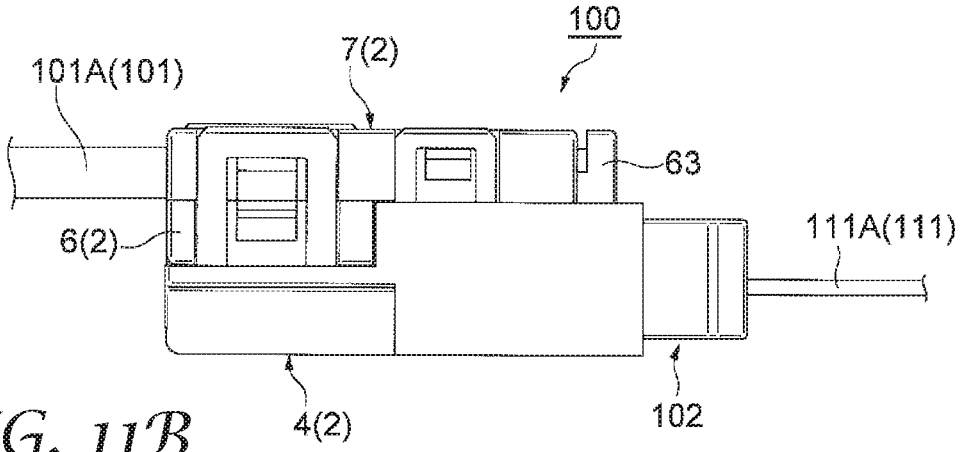
Figure 11C:
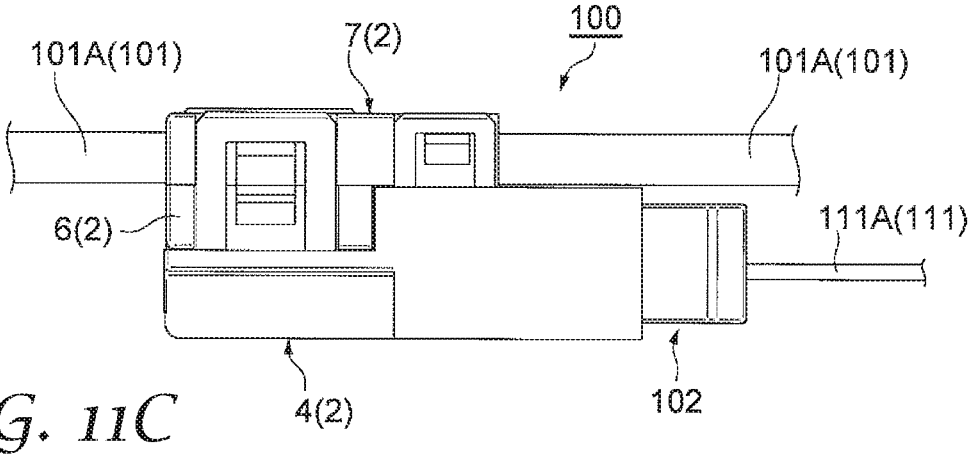

The lid portion 63 is spread in the y-axis direction along the end portion on the x-axis-direction negative side of the upper wall portion 61. The lid portion 63 is fixed to an end portion on the x-axis-direction negative side of the cover member 7. In this manner, when the lid portion 63 is fixed to the cover member 7, the cables 101 cannot extend to an outer side of the lid portion 63. Accordingly, as illustrated in (a) and (b) in FIG. 11, in a case where the lid portion 63 is provided, the cables 101 enter a state of extending to only one side in the x-axis direction relative to the connector 100. Meanwhile, as illustrated in (c) in FIG. 11, in a case where the lid portion 63 is removed, the cables 101 enter a state where they can extend to both sides in the x-axis direction relative to the connector 100.

[Spaces Formed in Housing]

A plurality of spaces is formed in the housing 2 by the support member 6 and the cover member 7 being installed to a cover member 7 such as that described above. As principally illustrated in FIG. 5, the housing 2 defines the upper-side space portion 71, the bottom-side space portion 72, the through holes 53, a perpendicular portion 73, and the channel portions 40. The upper-side space portion 71 is a space that extends in the x-axis direction, is spread in the y-axis direction, and houses the cables 101. The bottom-side space portion 72 is a space that is disposed on a lower side of the upper-side space portion 71 and extends in the x-axis direction. The bottom-side space portion 72 is a space that is spread in the xy direction along the upper surface 21*a* of the bottom wall portion 21 and the lower surface 6*c* of the support member 6. Note that the bottom-side space portion 72 is divided by the inner wall portion 24 (see FIG. 4). The through hole 53 is a space that extends in the z-axis direction (up-and-down direction) and communicates the upper-side space portion 71 and the bottom-side space portion 72, a plurality thereof being formed in the y-axis direction. The perpendicular portion 73 is a space extending in the z-axis direction that communicates the bottom-side space portion 72 and the channel portions 40. The perpendicular portion 73 is formed by a space surrounded by the upper surface 21*a* of the bottom wall portion 21, the side portion 44, the end surface 6*b* of the support member 6, and the inclined portion 46 of the channel portion 40. The channel portion 40 is a space that penetrates to the x-axis-direction positive side from an end portion on the positive side in the x-axis direction of the bottom-side space portion 72 toward the tip 16*a* of the protruding wall portion 16.

[Electrical Contact Terminal]

The electrical contact terminals 3 are a plurality of metal members that can contact the cables 101 and the terminal portions 110 (see FIGS. 9 and 10) of the mating connector 102. As principally illustrated in FIGS. 5, 7, and 8, a plurality (four in the present embodiment) of electrical contact terminals 3 is lined up in the y-axis direction. In the description below, these may be referred to sequentially from the y-axis-direction negative side to the y-axis-direction positive side as "electrical contact terminal 3A," "electrical contact terminal 3B," "electrical contact terminal 3C," and "electrical contact terminal 3D." The electrical contact terminal 3A is disposed in a position corresponding to the groove portion 52A, the through hole 53A, and the channel portion 40A. The electrical contact terminal 3B is disposed in a position corresponding to the groove portion 52B, the through hole 53B, and the channel portion 40B. The electrical contact terminal 3C is disposed in a position corresponding to the groove portion 52C, the through hole 53C, and the channel portion 40C. The electrical contact terminal 3D is disposed in a position corresponding to the groove portion 52D, the through hole 53D, and the channel portion 40D. The electrical contact terminal 3 is provided with a first contact portion 81, a second contact portion 82, and a relay portion 83.

The first contact portion 81 is a portion that is provided on the positive side in the x-axis direction of the electrical contact terminal 3, is inserted into the support member 6, and can contact the cables 101 supported by this support member 6. The first contact portion 81 bends from one end side on a positive side of the relay portion 83 extending in the x-axis direction toward the z-axis-direction positive side (upward). A lower end portion of the first contact portion 81 is disposed in the bottom-side space portion 72, an upper end portion of the first contact portion 81 is disposed in the upper-side space portion 71, and a portion between the lower end portion and the upper end portion of the first contact portion 81 is disposed in the through hole 53. A pair of blade portions 84 is formed in the upper end portion of the first contact portion 81. The pair of blade portions 84 extends in the z-axis direction and is disposed separated from each other in the y-axis direction. Accordingly, a slit portion 86 is formed between the pair of blade portions 48. The blade portions 48 and the slit portion 86 protrude upward from the groove portion 52 of the support member 6. The pair of blade portions 84 tears the covering of the cable 101 disposed in the groove portion 52 of the support member 6 and interposes by the slit portion 86 while contacting the conductor portion inside this cable 101. By this, the first contact portion 81 is electrically connected to the cable 101.

The second contact portion 82 is a portion that is provided on the negative side in the x-axis direction and can contact the terminal portions 110 of the mating connector 102. The second contact portion 82 is disposed in the channel portion 40 and extends in the x-axis direction; an end portion on the positive side in the x-axis direction bends to the z-axis-direction negative side and is disposed on the perpendicular portion 73. Specifically, the second contact portion 82 is provided with a tip portion 82*a* disposed in a vicinity of a tip of the channel portion 40, an inclined portion 82*b* inclined upward from the x-axis-direction negative side toward the x-axis-direction positive side, an abutting portion 82*c* abutted to the inclined portion 46 on an upper side of the channel portion 40, and a bent portion 82*d* that bends downward from an end portion on the x-axis-direction positive side of the abutting portion 82*c* and is disposed on the perpendicular portion 73. By such a configuration, in a case where the terminal portion 110 of the mating connector 102 is inserted into the channel portion 40, the tip portion 82*a* of the second contact portion 82 contacts this terminal portion 110 and is pushed upward (see particularly FIG. 5). In conjunction therewith, the second contact portion 82 deforms such that the tip portion 82*a* and the inclined portion 82*b* move upward with the abutting portion 82*c* that abuts the inclined portion 46 as a fulcrum. Accordingly, the tip portion 82*a* is pressed to the terminal portion 110 with a sufficient pressing force by an elastic force generated by the second contact portion 82.

The relay portion 83 is a portion extending to the positive side in the x-axis direction from the second contact portion 82. Moreover, the first contact portion 81 bends upward from an end portion on the x-axis-direction positive side of the relay portion 83. By such a configuration, the relay portion 83 connects the first contact portion 81 and the second contact portion 82. The relay portion 83 is disposed in the bottom-side space portion 72. The relay portion 83 is provided with a main body portion 83*a* extending rectilinearly in the x-axis direction and a position adjustment portion 83*b* that adjusts a position in the y-axis direction of the second contact portion 82 at an end portion on the x-axis-direction negative side of the main body portion 83*a*.

Here, a positional relationship between the electrical contact terminals 3A, 3B, 3C, 3D is described with reference to FIG. 8. In the present embodiment, compared to a pitch of the plurality of cables 101, a pitch of a plurality of cables 111 connected to the mating connector 102 is smaller. Accordingly, compared to a pitch in the y-axis direction of the first contact portion 81 of the electrical contact terminals 3, a pitch of the second contact portion 82 is smaller.

Figure 8:
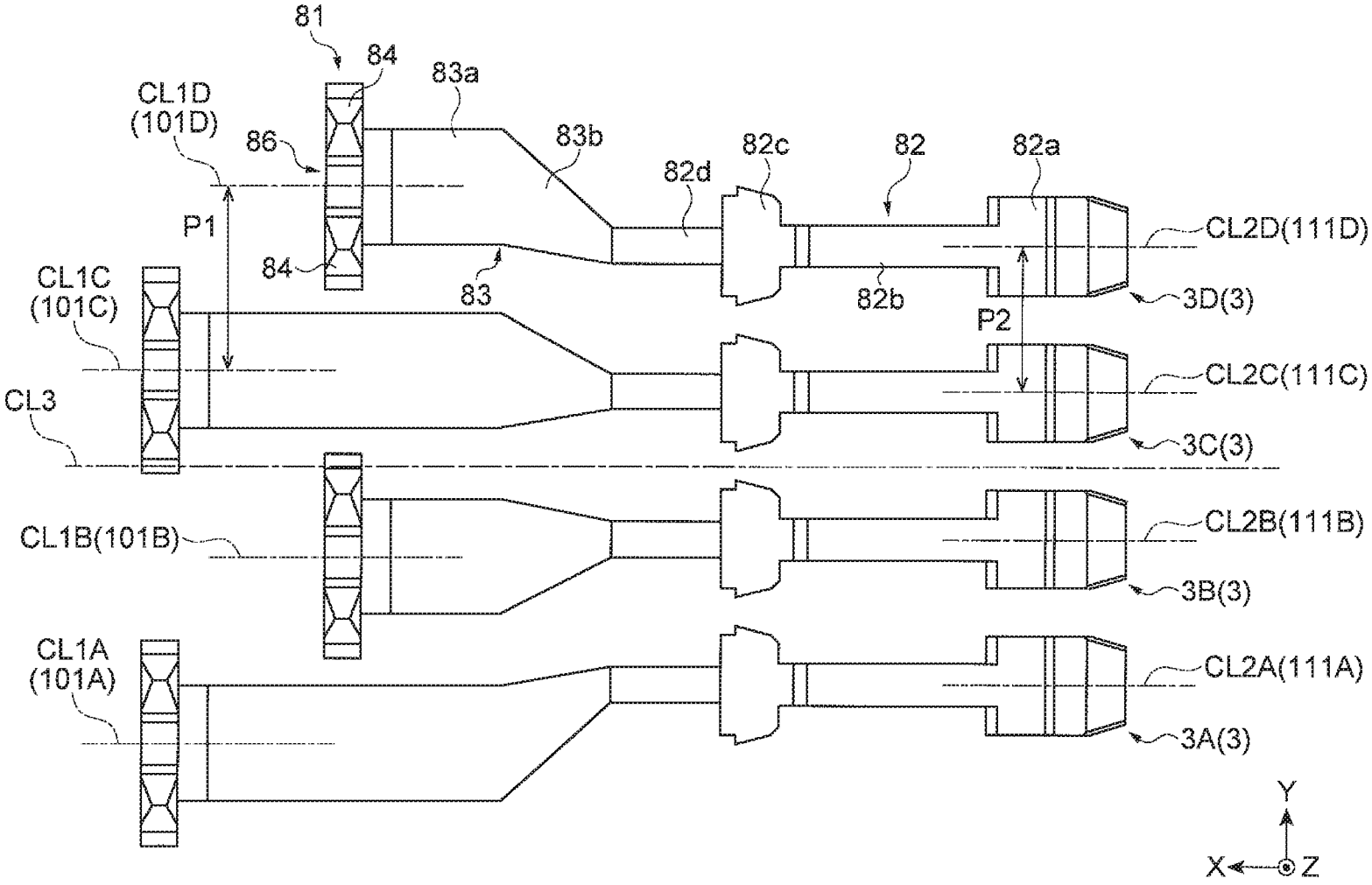
FIG. 8 A plan view of the electrical contact terminals of the connector according to the embodiment.

Specifically, as illustrated in FIG. 8, in a case where centerlines of cables 101A, 101B, 102, 101D are defined as "CL1A, CL1B, CL1C, CL1D," a disposition is such that central positions in the y-axis direction of the first contact portion 81 of the electrical contact terminals 3A, 3B, 3C, 3D substantially match the centerlines CL1A, CL1B, CL1C, CL1D. Note that a pitch of the centerlines CL1A, CL1B, CL1C, CL1D is illustrated as "P1" in the diagram.

In a case where centerlines of cables 111A, 111B, 111C, 111D of the mating connector 102 are defined as "CL2A, CL2B, CL2C, CL2D," a disposition is such that central positions in the y-axis direction of the second contact portion 82 of the electrical contact terminals 3A, 3B, 3C, 3D substantially match the centerlines CL2A, CL2B, CL2C, CL2D. Note that a pitch of the centerlines CL2A, CL2B, CL2C, CL2D is illustrated as "P2" in the diagram. The pitch P2 is smaller than the pitch P1. That is, the second contact portion 82 of the electrical contact terminals 3A, 3B, 3C, 3D is overall disposed in a position nearer to the centerline CL3 of the housing 2 than the first contact portion 81. Accordingly, the position adjustment portion 83B of the relay portion 83 of the electrical contact terminals 3A, 3B, 3C, 3D is provided so as to incline to a centerline CL3 side from the main body portion 83A toward the second contact portion 82. The position adjustment portion 83B of the electrical contact terminals 3A, 3D disposed on an outer side of the centerline CL3 has a greater incline than the position adjustment portion 83B of the electrical contact terminals 3B, 3C disposed on an inner side of the centerline CL3.

Moreover, by a configuration such as above, a pitch of the channel portions 40A, 40B, 40C, 40D becomes smaller compared to a pitch of the groove portions 52A, 52B, 52C, 52D of the support member 6; the through holes 53A, 53B, 53C, 53D; and the groove portions 69A, 69B, 69C, 69D of the cover member 7.

[Mating Connector]

Figure 9B:
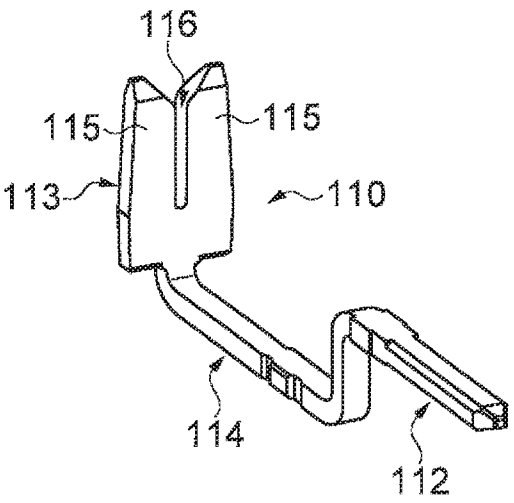
FIG. 9 A perspective view of a mating connector connected to the connector according to the embodiment.
Figure 9A:
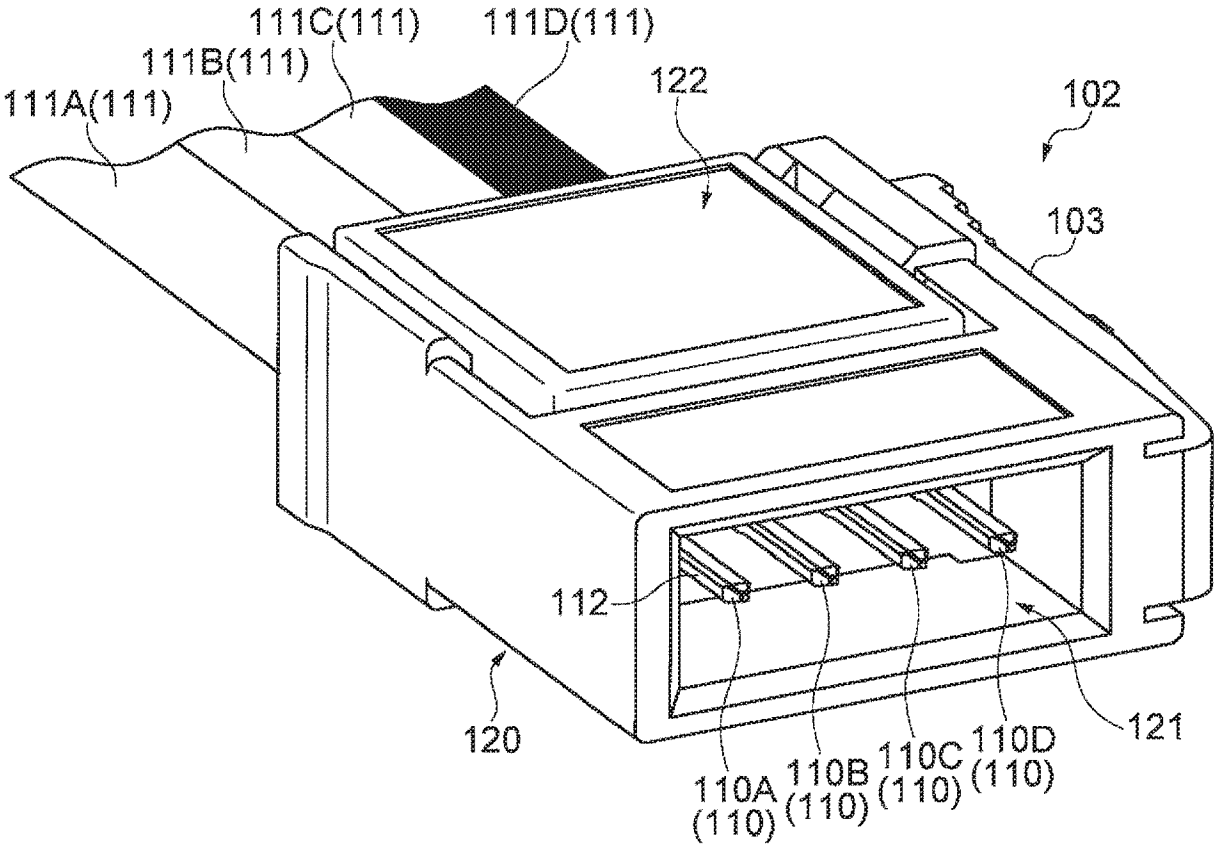
Figure 10:
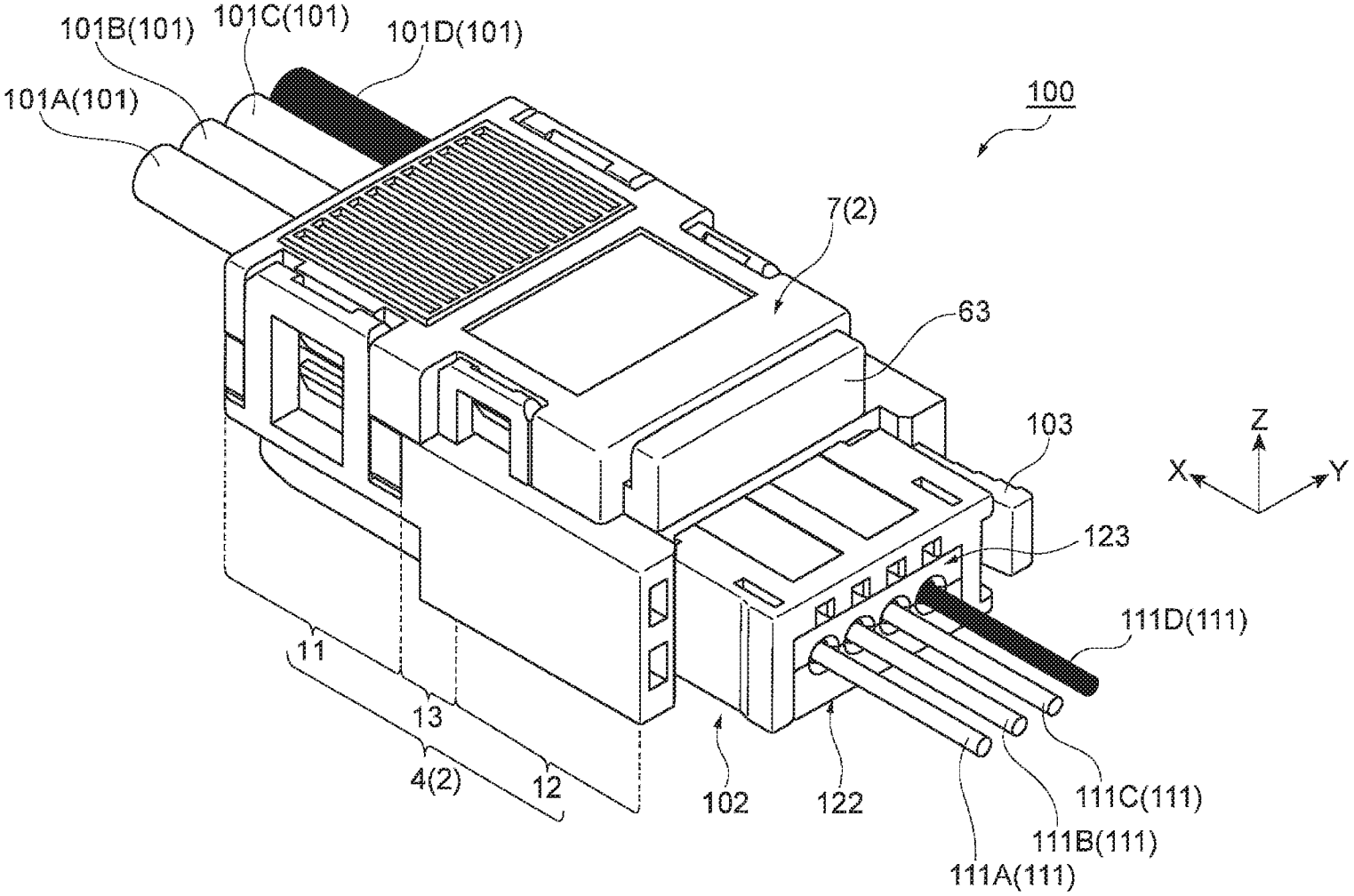
FIG. 10 A perspective view of the connector in a state where the mating connector and a cable are electrically connected.

As illustrated in (a) in FIG. 9, the mating connector 102 is provided with a housing 120 and the terminal portions 110 electrically connected to the cables 111. The housing 120 has a configuration of a flat, rectangular box. In the housing 120, a rectangular opening portion 121 is provided in an end portion on a side that receives the second receiving portion 12 of the base member 4 of the connector 100. A plurality (four in the present embodiment) of terminal portions 110 is lined up in the opening portion 121. The protruding wall portion 16 of the first receiving portion 11 of the base member 4 is inserted into this opening portion 121. In the housing 120, a support portion 123 (see FIG. 10) for supporting the cables 111 contacting the terminal portions 110 is formed at an end portion on an opposite side of the opening portion 121. The cables 111 are interposed by the support portion 123 and a cover member 122. Note that as illustrated in (b) in FIG. 9, the terminal portion 110 has a second contact portion 112 extending rectilinearly on an opening-portion 121 side, a first contact portion 113 bending upward at an end portion on a support-portion 123 side, and a relay portion 114 connecting the second contact portion 112 and the first contact portion 113. The first contact portion 113 has blade portions 115 and a slit portion 116 of the same purpose as the blade portions 84 and the slit portion 86 of the electrical contact terminal 3 described above. By this, the cables 111 supported by the support portion 123 and the first contact portion 113 of the terminal portion 110 make contact. Note that in the housing 120, a portion where the first contact portion 113 of the terminal portion 110 and the cable 111 make contact is covered by the cover member 122. Moreover, a claw portion 103 that mates with the slit portion 37 of the first receiving portion 11 of the base member 4 is provided on one sidewall portion of the housing 120.

Next, actions and effects of the connector 100 according to the present embodiment are described.

The cable 101 supported by the support member 6 received by the first receiving portion 11 of the base member 4 and the cover member 7 contacts the first contact portion 81 of the electrical contact terminal 3. The terminal portion 110 of the mating connector 102 received by the second receiving portion 12 of the base member 4 contacts the second contact portion 82 of the electrical contact terminal 3. By this, the cables 101 and the mating connector 102 are electrically connected in a state of being supported by the connector 100. Here, the protruding wall portion 16 is disposed inside the second receiving portion 12 that can receive the mating connector 102. Moreover, the plurality of channel portions 40 that penetrates in the x-axis direction and can receive the terminal portions 110 of the mating connector 102 is formed in the protruding wall portion 16 and the bulkhead portion 13. The second contact portion 82 of the plurality of electrical contact terminals 3 is housed in the channel portion 40. The plurality of channel portions 40 configured in this manner is formed so as to be separated from each other in the y-axis direction. That is, the channel portions 40 are in a state spatially separated from each other by the horizontal wall portions 42 of the protruding wall portion 16. Accordingly, the terminal portions 110 of the mating connector 102 received by each channel portion 40 are separated from each other by the horizontal wall portions 42 of the protruding wall portion 16. By such a configuration, the terminal portions 110 are prevented from electrically contacting or approaching each other and reliability of electrical connection between the cables 101 and the mating connector 102 can be improved.

Particularly, in a case as in the present embodiment where compared to the cables 101 the cables 111 of the mating connector 102 are thinner and have a smaller pitch, a pitch of the terminal portion 110 also becomes small. Accordingly, when contacting the electrical contact terminal 3 of the connector 100 and the terminal portion 110, a possibility increases of contacting another electrical contact terminal 3 or terminal portion 110. However, by adopting a structure of the connector 100 according to the present embodiment, as described above, the terminal portions 110 are prevented from electrically contacting or approaching each other. Note that according to a structure of the present embodiment, the electrical contact terminals 3 can be housed inside the protruding wall portion 16; therefore, a finger of a user contacting the electrical contact terminal 3 can also be prevented. Particularly, there may be a demand to perform a connecting operation of the cable 101 and the mating connector 102 without cutting off power. In this case, effects such as above are exhibited with particular remarkability.

As described above, a connector according to one aspect of the present invention is a connector that electrically connects a cable and a mating connector, provided with: a support member that can support the cable; a base member provided with a first receiving portion that is provided on one side in a length direction and can receive the support member and a second receiving portion that is provided on another side in the length direction and can receive the mating connector; a cover member that is installable to the base member from an upper side and covers the support member received by the first receiving portion; and a plurality of electrical contact terminals that can contact the cable and terminal portions of the mating connector; wherein the plurality of electrical contact terminals is provided with a first contact portion that is provided on one side in the length direction, is inserted into the support member, and can contact the cable supported by this support member and a second contact portion that is provided on another side in the length direction and can contact the terminal portions of the mating connector; the base member is provided with a bulkhead portion formed between the first receiving portion and the second receiving portion and a protruding wall portion protruding to another side in the length direction from the bulkhead portion in toward the second receiving portion; a plurality of channel portions that penetrates in the length direction and can receive the terminal portions of the mating connector is formed in the protruding wall portion and the bulkhead portion; the plurality of channel portions is formed so as to be separated from each other in a width direction orthogonal to the length direction; and the second contact portion of the plurality of electrical contact terminals is housed in the plurality of channel portions.

In such an aspect, the cable, supported by the support member, which is received by the first receiving portion of the base member, and the cover member, contacts the first contact portion of the electrical contact terminals. The terminal portions of the mating connector, which is received by the second receiving portion of the base member, contact the second contact portion of the electrical contact terminals. By this, the cable and the mating connector are electrically connected in a state of being supported by the connector. Here, the protruding wall portion is disposed inside the second receiving portion that can receive the mating connector. Moreover, the plurality of channel portions that penetrates in the length direction and can receive the terminal portions of the mating connector is formed in the protruding wall portion and the bulkhead portion. The second contact portion of the plurality of electrical contact terminals is housed in the channel portions. The plurality of channel portions configured in this manner is formed so as to be separated from each other in the width direction orthogonal to the length direction. That is, the channel portions are in a state of being spatially separated from each other by walls of the protruding wall portion. Accordingly, the terminal portions of the mating connector received in the channel portions are separated from each other by the walls of the protruding wall portion. By such a configuration, the terminal portions are prevented from electrically contacting or approaching each other and reliability of electrical connection between the cable and the mating connector can be improved.

Moreover, in a connector according to another aspect, an opening portion of a channel portion may be formed in a tip of a protruding wall portion and a taper may be formed in a peripheral portion of the opening portion. By such a configuration, even in a case supposing that positioning between a terminal portion of a mating connector and the opening portion of the channel portion is shifted and, when inserting the terminal portion into the opening portion, the terminal portion and the peripheral portion of the opening portion collide, due to the taper, the terminal portion does not buckle and is guided smoothly to the opening portion. By this, for example, even in a case where the cable of the mating connector is a thin cable and the terminal portion also becomes thin, this terminal portion can be suppressed from buckling.

Moreover, in a connector according to another aspect, a second receiving portion may be provided with a peripheral wall portion that, when viewing one side in a length direction from another side in the length direction, is disposed so as to surround a protruding wall portion and extends in the length direction. By such a configuration, a finger or the like of an operator approaching an electrical contact terminal can be reliably suppressed by the peripheral wall portion due to the peripheral wall portion surrounding the protruding wall portion, which houses the electrical contact terminal.

Moreover, in a connector according to another aspect, an electrical contact terminal may be provided with a relay portion extending from a second contact portion to one side in a length direction, wherein a first contact portion bends upward from one end side in the length direction of the relay portion and a support member has a through hole extending in an up-and-down direction into which a first contact portion is inserted. By such a configuration, a cable in a state of being supported by the support member can be made to contact the first contact portion by a simple configuration.

Moreover, in a connector according to another aspect, a first receiving portion may be provided with a bottom wall portion extending to one side in a length direction from a bulkhead portion, a support member in a state of being received by the first receiving portion may be disposed in a position separated upward from the bottom wall portion, and a bottom-side space portion may be formed between the support member in the state of being received by the first receiving portion and the bottom wall portion. By such a configuration, the bottom-side space portion can be effectively utilized as a space for disposing a portion of an electrical contact terminal.

Moreover, in a connector according to another aspect, a plurality of groove portions extending along a length direction may be formed in a width direction in an upper surface of a support member. By such a configuration, a cable can be supported by the groove portions in the upper surface of the support member.

Moreover, in a connector according to another aspect, a cover member may extend in a length direction to a position corresponding to a second receiving portion and an upper-side space portion that can house a cable may be formed between the cover member and the second receiving portion and between the cover member and a support member. By such a configuration, the upper-side space portion formed by the cover member can be effectively utilized as a space for disposing the cable.

Moreover, a connector according to another aspect is a connector that electrically connects a cable and a mating connector, provided with: a housing extending from one side to another side in a length direction; and a plurality of electrical contact terminals that can contact the cable and terminal portions of the mating connector; wherein the housing defines an upper-side space portion that extends in the length direction and houses the cable; a bottom-side space portion that is disposed on a lower side of the upper-side space portion and extends in the length direction; a plurality of through holes that extends in an up-and-down direction, communicates the upper-side space portion and the bottom-side space portion, and is formed in a width direction orthogonal to the length direction; and a plurality of channel portions penetrating from an end portion on another side in the length direction of the bottom-side space portion to this other side in the length direction; the plurality of channel portions is formed so as to be separated from each other in the width direction; and the plurality of electrical contact terminals is provided with a first contact portion that can contact the cable that penetrates the through hole and protrudes into the upper-side space portion, a second contact portion that is disposed in the channel portion and can contact the terminal portions of the mating connector, and a relay portion that extends to one side in the length direction in the bottom-side space portion from the second contact portion, the first contact portion bending upward from one end side in the length direction.

In such an aspect, by the plurality of channel portions separated from each other in the width direction being had, actions and effects similar to those of the connectors described above can be obtained. Moreover, by defining space portions such as those described above in the housing, space for disposing the electrical contact terminals can be effectively ensured.

The present invention is not limited to the embodiment described above.

For example, in the embodiment described above, an example is described of a case where, as one example, the connector connects four cables; however, the number of cables is not limited and may be any number as long as it is plural.

Moreover, shapes of the base member, the support member, the cover member, and the electrical contact terminal may be changed as appropriate in a range in keeping with the spirit of the present invention. For example, shapes and lengths of each wall portion of the first receiving portion and the second receiving portion of the cover member are not limited to the embodiment described above, and a portion of the wall portions may be omitted as appropriate. Moreover, shapes and lengths of the wall portions of the cover member may be changed as appropriate. Moreover, a shape of the electrical contact terminal may be changed to match shape changes of these members.

REFERENCE SIGNS LIST

2 . . . housing, 3 . . . electrical contact terminal, 4 . . . base member, 6 . . . support member, 7 . . . cover member, 11 . . . first receiving portion, 12 . . . second receiving portion, 13 . . . bulkhead portion, 13*a* . . . front wall surface, 13*b* . . . rear wall surface, 16 . . . protruding wall portion, 16*a* . . . tip, 30 . . . peripheral wall portion, 40 . . . channel portion, 41 . . . opening portion, 43 . . . taper, 52 . . . groove portion, 53 . . . through hole, 71 . . . upper-side space portion, 72 . . . bottom-side space portion, 81 . . . first contact portion, 82 . . . second contact portion, 83 . . . relay portion, 100 . . . connector, 101 . . . cable, 102 . . . mating connector.

The invention claimed is:

1. A connector that electrically connects a cable and a mating connector, comprising:

a support member that can support the cable;

a base member provided with a first receiving portion that is provided on one side in a length direction and can receive the support member and a second receiving portion that is provided on another side in the length direction and can receive the mating connector;

a cover member that is installable to the base member from an upper side and covers the support member received by the first receiving portion; and a plurality of electrical contact terminals that can contact the cable and terminal portions of the mating connector; wherein the plurality of electrical contact terminals is provided with a first contact portion that is provided on one side in an up-and-down direction, is inserted into the support member, and can contact the cable supported by the support member and a second contact portion that is provided on another side in the length direction and can contact the terminal portions of the mating connector;

the base member is provided with a bulkhead portion formed between the first receiving portion and the second receiving portion and a protruding wall portion protruding to another side in the length direction from the bulkhead portion in toward the second receiving portion, wherein the protruding wall portion is disposed apart from a bottom wall portion of the second receiving portion, as measured along the up-and-down direction;

a plurality of channel portions that penetrates in the length direction and can receive the terminal portions of the mating connector is formed in the protruding wall portion and the bulkhead portion;

the plurality of channel portions is formed so as to be separated from each other in a width direction orthogonal to the length direction; and the second contact portion of the plurality of electrical contact terminals is housed in the plurality of channel portions.

2. The connector according to claim 1, wherein an opening portion of the channel portion is formed in a tip of the protruding wall portion and a taper is formed in a peripheral portion of the opening portion.

3. The connector according to claim 1, wherein the second receiving portion, when viewing the one side from the other side in the length direction, is disposed so as to surround the protruding wall portion and is provided with a peripheral wall portion extending in the length direction.

4. The connector according to claim 1, wherein the electrical contact terminal is provided with a relay portion extending from the second contact portion to the one side in the length direction, the first contact portion bending upward from one end side in the length direction of the relay portion, and the support member has a through hole extending in an up-and-down direction into which the first contact portion is inserted.

5. The connector according to claim 1, wherein the first receiving portion is provided with a bottom wall portion extending from the bulkhead portion to the one side in the length direction;

the support member, in a state of being received by the first receiving portion, is disposed in a position separated upward from the bottom wall portion; and a bottom-side space portion is formed between the support member in the state of being received by the first receiving portion and the bottom wall portion.

6. The connector according to claim 1, wherein a plurality of groove portions extending along the length direction is formed in the width direction in an upper surface of the support member.

7. The connector according to claim 1, wherein the cover member extends in the length direction to a position corresponding to the second receiving portion and an upper-side space portion that can house the cable is formed between the cover member and the second receiving portion and between the cover member and the support member.

8. A connector that electrically connects a cable and a mating connector, comprising:

a housing extending from one side to another side in a length direction; and a plurality of electrical contact terminals that can contact the cable and terminal portions of the mating connector; wherein the housing defines an upper-side space portion that extends in the length direction and houses the cable;

a bottom-side space portion that is disposed on a lower side of the upper-side space portion and extends in the length direction;

a plurality of through holes that extends in an up-and-down direction, communicates the upper-side space portion and the bottom-side space portion, and is formed in a width direction orthogonal to the length direction; and a plurality of channel portions penetrating from an end portion on the other side in the length direction of the bottom-side space portion to the other side in the length direction;

the plurality of channel portions is formed so as to be separated from each other in the width direction; and the plurality of electrical contact terminals is provided with a first contact portion that can contact the cable that penetrates the through hole and protrudes into the upper-side space portion, a second contact portion that is disposed in the channel portion and can contact the terminal portions of the mating connector, and a relay portion that extends to the one side in the length direction in the bottom-side space portion from the second contact portion, the first contact portion bending upward from one end side in the length direction, and a cover member that covers the upper-side space portion.

9. The connector of claim 1, wherein the protruding wall portion is disposed above a bottom wall portion of the second receiving portion, as measured along the up-and-down direction.

10. The connector of claim 1, wherein a non-zero distance exists between the protruding wall portion and a bottom wall portion of the second receiving portion, as measured along the up-and-down direction.

11. The connector of claim 8, further including a support member defining groove portions extending along the length direction, wherein the upper-side space portion extends beyond the groove portions along the length direction.

12. The connector of claim 8, wherein at least a portion of the relay portion is disposed below the second contact portion as measured along the up-and-down direction.

13. The connector of claim 8, wherein at least a portion of the relay portion is angled as measured within a plane defined by the X axis and Y axis.

* * * * *